US006672116B1

(12) United States Patent
Hilliard

(10) Patent No.: US 6,672,116 B1
(45) Date of Patent: Jan. 6, 2004

(54) DOUBLE-LOCKING MECHANISM FOR HANDCUFFS

(75) Inventor: Daniel T. Hilliard, Butler, PA (US)

(73) Assignees: Jeffrey A. Cooper, Butler, PA (US); Robert A. Gagliardi, Butler, PA (US); part interest ( * ) Notice: Subject to any disclaimer, the term of this patent is extended or adjusted under 35 U.S.C. 154(b) by 0 days.

(21) Appl. No.: 10/302,407

(22) Filed: Nov. 22, 2002

(51) Int. Cl.[7] ..... E05B 75/00
(52) U.S. Cl. ..... 70/16
(58) Field of Search ..... 70/15–19

(56) References Cited

U.S. PATENT DOCUMENTS

| | | | | |
|---|---|---|---|---|
| 200,950 A | * | 3/1878 | Tower et al. | |
| 2,510,294 A | * | 6/1950 | Rivolier | |
| 4,509,346 A | | 4/1985 | Szczepanek | 70/16 |
| 5,660,064 A | | 8/1997 | Ecker et al. | 70/16 |
| 6,574,998 B2 | * | 6/2003 | Kwon | 70/16 |

* cited by examiner

*Primary Examiner*—Lloyd A. Gall
(74) *Attorney, Agent, or Firm*—Carothers and Carothers

(57) ABSTRACT

A double-locking mechanism for handcuffs, which include a pawl-and-ratchet mechanism wherein the ratchet pawl is spring biased to couple with a pivotal ratchet jaw arm within in a shackle casing and a bolt is provided for engaging the pawl to prevent the coupled jaw from pivoting in either direction in order to double lock the mechanism. A pivot slide mechanism is provided whereby either the pawl or the bolt is not only permitted to pivot about an axis within the casing, but is also permitted to have limited displacement in a direction transverse to its pivot axis which thereby causes the pawl to engage a stop within the casing to double lock the pawl from pivoting in either direction and also causes the bolt under bias to displace from a first bolt position to a second bolt position and thereby engage and retain the pawl in the double lock position against the stop in order to ensure that the mechanism will remain double locked until opened with a key. This design permits double locking of the mechanism merely by pulling either the jaw arm or shackle chain away from the shackle casing to provide quick double locking without the required use of an additional key or pin.

15 Claims, 6 Drawing Sheets

DOUBLE-LOCKING MECHANISM FOR HANDCUFFS

FIELD OF THE INVENTION

This invention relates to shackles and more particularly to handcuffs, and leg irons, with double-locking mechanisms.

BACKGROUND OF THE INVENTION

Handcuffs, such as those shown in U.S. Pat. No. 4,509,346, issued to Szczepanek, typically have a pair of arcuate frame parts, known as a jaw and casing cheek, that are pivotally coupled to one another. A pawl-and-ratchet mechanism permits one-way rotational movement of the jaw as it pivots through the spaced apart arms or plates that form the cheek on the shackle casing. Teeth on the pawl ride over complementary ratchet teeth in the jaw, as the jaw rotates into the cheek, to lock the cuff around a person's wrist. Spring pressure against the pawl is provided to prevent the jaw from backing off and unlocking the cuff.

This basic structure is improved by the addition of a slide bolt that overlays the pawl, inside the casing. When a small key end is pushed into a side channel of the casing, a separate drift pin carried in the channel moved against an end of the bolt. Continued pressure causes the bolt to slide so that an interference surface on the bolt then abuts the pawl. This surface blocks the pawl to prevent it from being depressed, and holds the pawl in place acting as a "double lock". This double lock not only prevents the jaw from being picked open, but it also prevents over tightening of the cuff and possible injury to the person being cuffed. Slide bolts were thereafter further modified as, for example, illustrated in U.S. Pat. No. 5,660,064, issued to Ecker et al.

In order to provide an illustration of how the prior art double-locking mechanisms generally operate, the prior art structure of U.S. Pat. No. 4,509,346 is shown as "Prior Art" herein as FIG. 2. As depicted in FIG. 2 and described in the Szczepanek patent, "The unintentional movement of the bolt into its double-locking position is prevented by providing a restraining means a spring loaded pin [element number 27 in the patent's drawings]—that operates against the casing and the bolt to resiliently urge the bolt against the latch and against the spreading of the action of mating shoulders [24, 25] on the bolt and latch that cause the two to spread apart against the action of the restraining means as the bolt moves forward toward the double-locking position and the shoulders engage." The elements of FIG. 2 are designated with the identical numbers provided in the Szczepanek patent except they are primed.

SUMMARY OF THE INVENTION

The double-locking mechanism of the present invention is provided for shackles of the type having a pawl-and-ratchet mechanism, including a spring biased pivotal ratchet pawl that couples a pivotal ratchet jaw arm with a shackle casing, and further includes a bolt for providing engagement with the pawl to prevent the coupled jaw from pivoting in either direction. The improvement includes a pivot slide mechanism in the handcuff or shackle casing which not only permits pivotal movement of a selected one of either the pawl or the bolt about a pivotal axis toward and away from the jaw arm, but also permits this selected one of the pawl or bolt to have limited displacement transversely of its pivot axis. When the selected one of the pawl or bolt is engaged and pulled by a connecting member from a first lock position to a second lock position, the pawl is caused to engage a stop for retaining the pawl in a double locked position. In other words, either the pawl or the bolt may be provided with this pivot slide mechanism whereby when the pawl or bolt so provided is displaced transversely from its pivotal axis, this displacement will cause the pawl to engage a stop within the shackle casing to retain the pawl in the double locked position.

In addition, the bolt is spring biased and dimensioned whereby the bolt is biased from a first bolt position to a second bolt position to thereby engage and retain the pawl in the double locked position against the stop upon the selected one of the pawl or the bolt being displaced to the aforedescribed second lock position. Accordingly, the bolt is spring biased to displace and hold the pawl from disengaging from its double locked position so that the jaw arm cannot be compressed to a further closed position whereby the individual being handcuffed could be injured.

The pivot slide mechanism may be comprised of a pivot pin which is fixed in the handcuff or shackle casing and received in a guide slot in the selected one of the pawl or the bolt for limited lateral displacement. As an alternative, the pivot slide mechanism may be comprised of a pivot pin which is fixed in the selected one of the pawl or the bolt and the extended ends of the pivot pin are permitted to slide in corresponding transverse slots provided on the inside of the casing. When the pivot slide mechanism is provided on the pawl, then the connecting member used to displace the pawl as permitted by the pivot slide mechanism is the jaw arm itself of the handcuff or shackle. In other words, the handcuff is quickly and easily double locked by merely pulling the main body or casing of the cuff casing whereby the jaw arm of the cuff engages the wrist or ankle of the person being shackled and thereby causes the locking arm to displace the pawl and double lock the shackle.

In addition, a pawl spring is provided in the casing and is biased against the pawl to return the pawl to the first lock position when the bolt is displaced from the second bolt position to the first bolt position during unlocking of the cuff with a key. The bolt may either be slidably or pivotally received within the shackle casing and is spring biased such that it is urged to displace toward the pawl.

In an alternative embodiment of the present invention, the pivot slide mechanism may be provided on the bolt instead of the pawl and the connecting member engages the bolt and extends to the exterior of the shackle casing for hand engagement. In this embodiment, the connecting member would typically include the shackle chain extending from and between the cuff shackle casings. Thus, after the cuff is initially applied to the person being detained, the cuff is then easily double locked by merely pulling the shackle chain against a spring bias away from the shackle casing to cause the bolt to displace from its first bolt position to the second bolt position for retaining the pawl in its double locked position.

BRIEF DESCRIPTION OF THE DRAWINGS

The accompanying drawings show, for the purpose of exemplification, without limiting the invention or appended claims, certain practical embodiments of the present invention wherein:

DETAILED DESCRIPTION OF THE PREFERRED EMBODIMENTS

Figure 1:
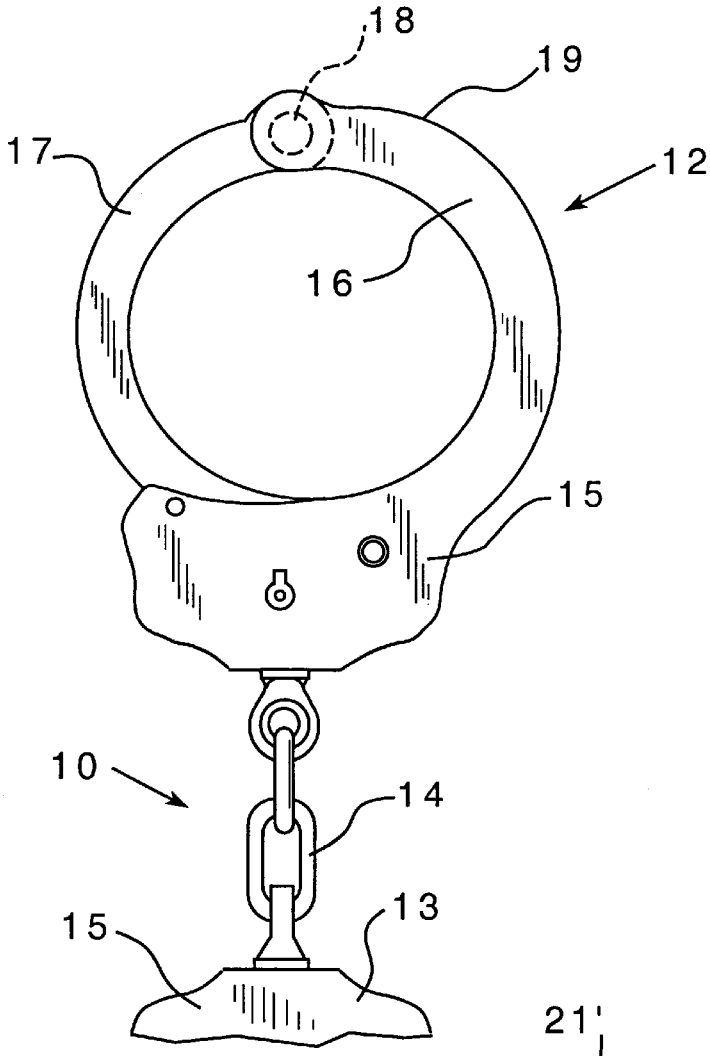
FIG. 1 illustrates a pair of handcuffs, with portions of one cuff broken away, to illustrate the external construction and casings for the double-locking mechanism of the present invention.
Figure 2:
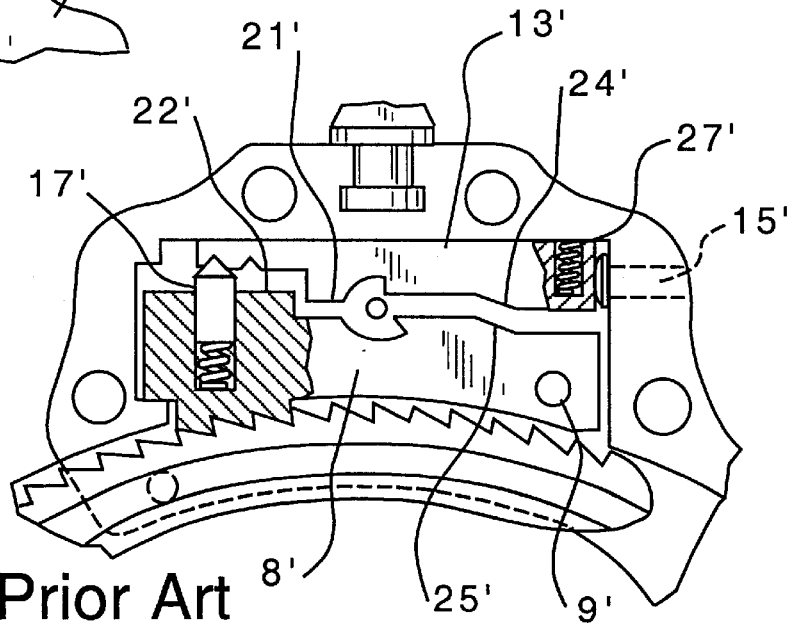
FIG. 2 Prior Art
FIG. 2 shows an internal view with a portion of the handcuff casing removed to disclose the double-locking assembly of U.S. Pat. No. 4,509,346, issued to Szczepanek.
Figure 3:
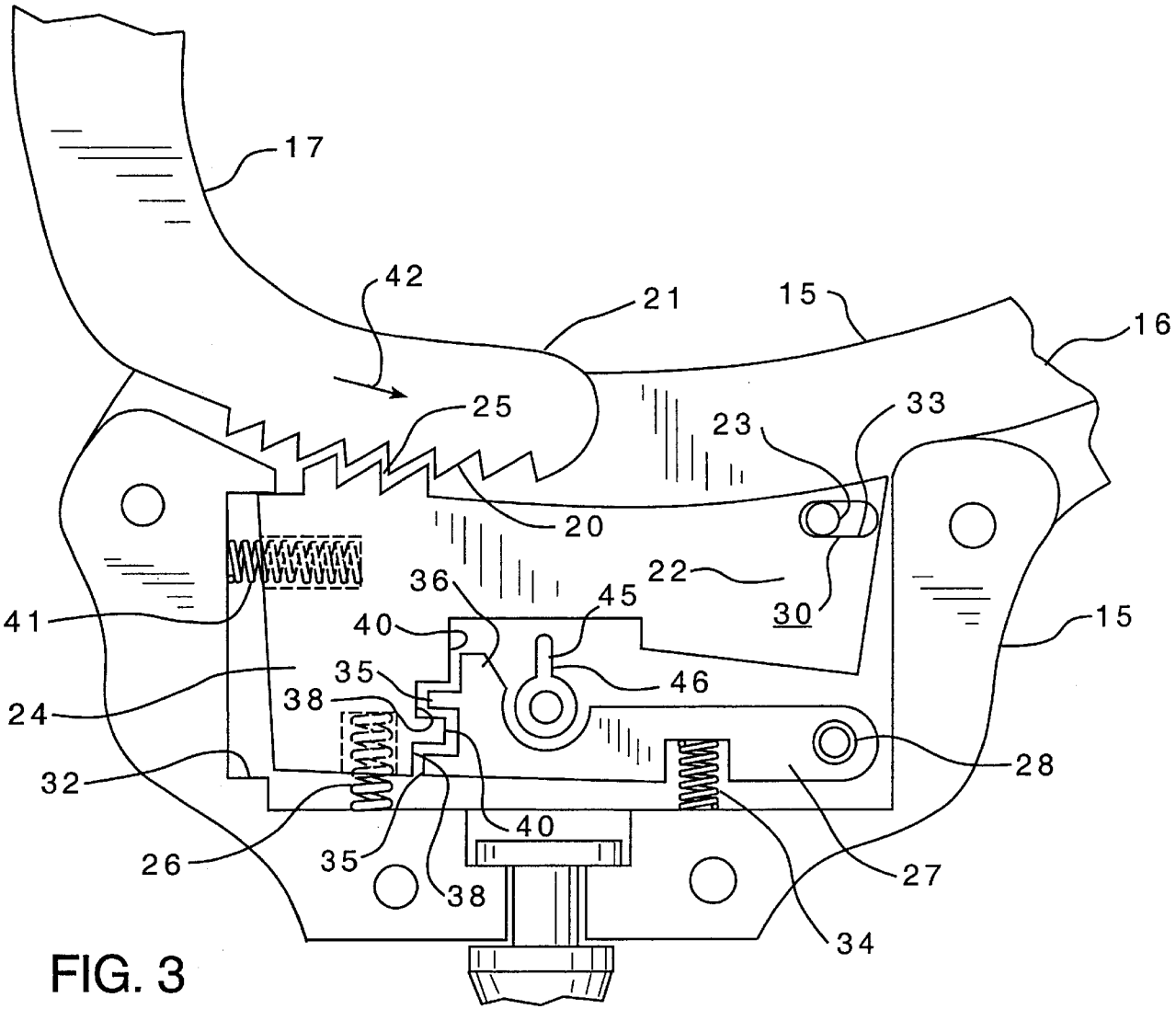
FIGS. 3 and 4 are enlarged action views illustrating the double-locking mechanism of the present invention in locked and double locked positions respectively.
Figure 4:
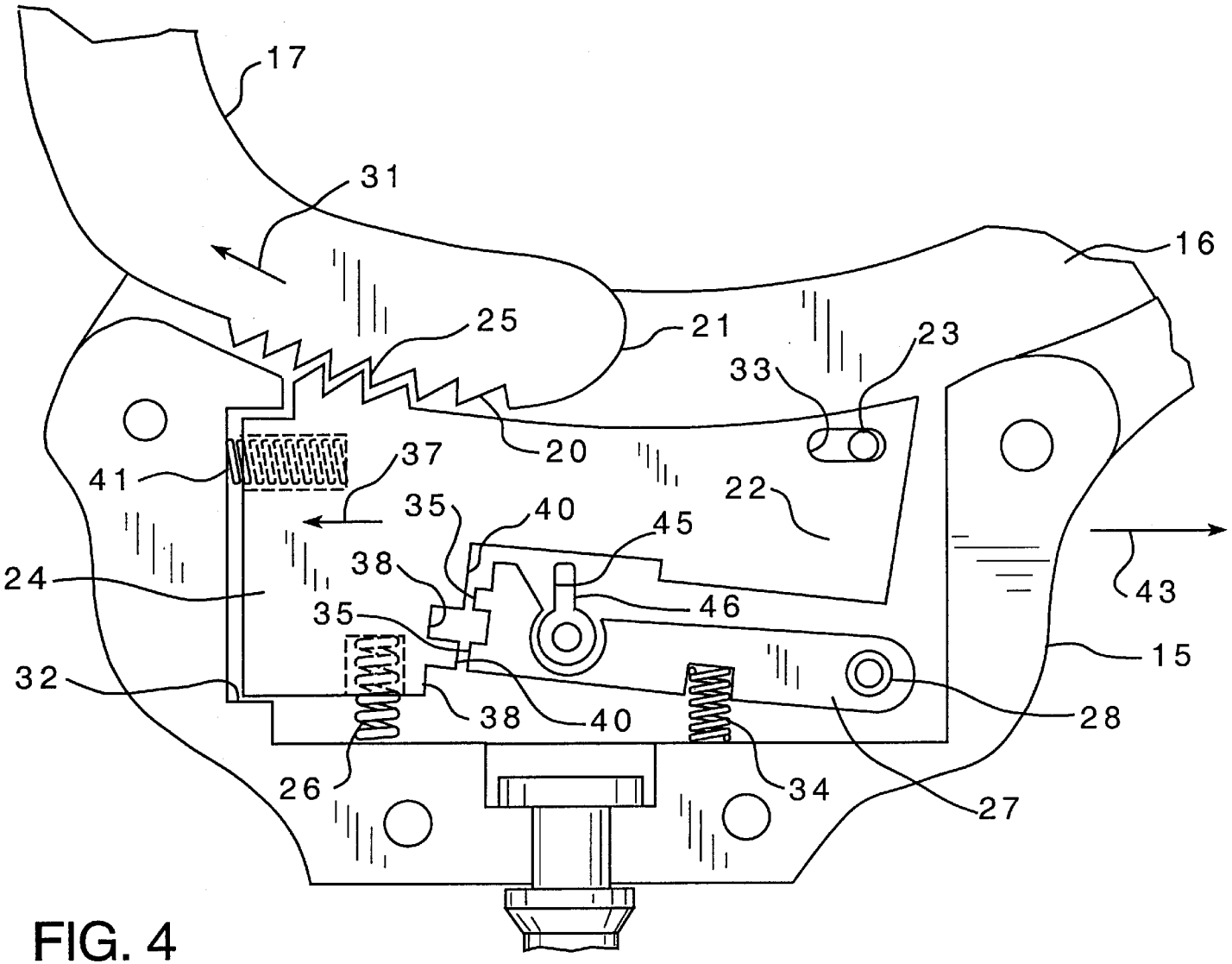

The inventor's most preferred embodiment is disclosed in FIGS. 1, 3 and 4. FIG. 3 illustrates the double-locking mechanism of the present invention in the first locked position, and FIG. 4 illustrates the same mechanism in the double locked position.

The double locking shackle of the present invention is generally illustrated at 10 in FIG. 1. The shackle 10 is made up of a pair of handcuffs 12 and 13 permanently linked together by chain 14. Each cuff is provided with a casing 15, a fixed arm 16, one end which is held by casing 15. A moveable arcuate locking arm 17 is pivotally mounted at one end 18 to the other end 19 of fixed arm 16. Moveable arcuate locking arm 17 is provided with a first series of inclined teeth 20 at its free end 21. Locking arm 17 is dimensioned whereby the free end 21 can move circularly through one side of the casing 15.

An elongated pawl 22 is pivotally mounted with pivot pin 23 within casing 15. The free end 24 of pawl 22 has a second series of inclined teeth 25 dimensioned to engage the first series of inclined teeth 20 as illustrated. Pawl 22 is biased by spring 26 which acts a retaining means resiliently urging pawl 22 with its second series of inclined teeth 25 against the first series of teeth 20 permitting closure of the locking arm 17, but not opening thereof.

A pivot slide mechanism 30 is provided and includes pivot 23 which permits pivotal movement of pawl 22 about its pivot axis toward and away from locking arm 17 and also permits limited lateral displacement of pawl 22 transversely to the pivot axis of pivot 23 when engaged and pulled by locking arm 17, as indicated by motion arrow 31 illustrated in FIG. 4, from a first lock position to a second double locked position whereby pawl 22 engages stop 32 in casing 15 for retaining pawl 22 in the double locked position. This lateral displacement of pawl 22 is permitted by the guide slot 33 in pawl 22 whereby engagement of the pawl 22 with the left inner wall of the casing 15 limits the displacement of pawl 22.

Elongated bolt 27 is provided within casing 15 adjacent pawl 22 as illustrated and bolt 27 is pivotally connected by pivot pin 28 at one end to casing 15. Bolt 27 is continually urged toward pawl 22 by the bias of spring 34. Bolt 27 further includes two protrusions 35 extending from its free end 36 in the direction of displacement of pawl 22 as indicated by arrow 37 to its double locked position as illustrated in FIG. 4. Corresponding recesses 38 are provided in pawl 22 for receiving the bolt protrusions 35 when bolt 27 is in its first bolt position illustrated in FIG. 3.

Corresponding steps 40 are provided on pawl 22 and are positioned adjacent the recesses 38 and away from bolt 27 and are dimensioned whereby the protrusions 35 engage steps 40 when bolt 27 is pivoted upwardly to its second bolt position as illustrated in FIG. 4 whereby pawl 22 is thereby retained in the double locked position against stop 32 and against the bias of its pawl spring 41.

The overall operation of the double-locking mechanism will now be described.

Assuming that the wrist of a person to be detained is positioned between moveable arm 17 and fixed arm 16 of the cuff or shackle illustrated in FIG. 3, the cuff arm 17 is closed as illustrated by pivoting arm 17 as indicated by the direction of arrow 42. Therefore, the restraining means as provided by spring 26 resiliently urges pawl 22 with its second series of inclined teeth 25 against the first series of inclined teeth 20 of arm 17 permitting closure of the locking arm but not opening thereof. However, to this point the cuff is not double locked.

To double lock the cuff as illustrated in FIG. 4, one merely pulls the casing 15 in a direction as indicated by arrow 43 which thereby causes the inside of arm 17 to engage the wrist of the person being shackled, which in turn causes a small force to be applied against arm 17 and to slightly displace arm 17 as indicated by arrow 31 which displaces pawl 22 to the left due to slot 33 of pivot mechanism 30 to double lock pawl 22. Pawl 22 is double locked because it engages step 32 and due to the displacement of pawl 22, protrusions 35 of bolt 27 are disengaged from corresponding recesses 38 of pawl 22 whereby bolt 27 is free to pivot upwardly about its pivot 28 due to the urging of spring 34 to now position protrusions 35 against shoulders 40 of pawl 22 as illustrated in FIG. 4. This prevents pawl 22 from displacing back to right due to the bias of spring 41 and requires pawl 22 to remain in the double locked position.

A key-way 45 is provided in casing 15 adjacent bolt 27 whereby a key 46 may be inserted into casing 15 between bolt 27 and pawl 22. Bolt 27 is dimensioned to receive and engage key 46 when the key is turned in either direction whereby key 46 will engage upper surfaces of bolt 27 to push or place bolt 27 back into its first bolt position illustrated in FIG. 3 from its second position as illustrated in FIG. 4. Thereafter, when key 46 is turned further, it applies further downward pressure against bolt 27 and thereby serves to also retract pawl 22 to disengage the pawl 22 from the jaw arm 17 for release of the cuff.

FIGS. 5–8 illustrate four additional embodiments of the double-locking mechanism of the present invention which, while varying in structural detail, operate in substantially the same manner to accomplish the same results of the double-locking mechanism illustrated in FIGS. 3 and 4. Accordingly, identical or similar parts are designated with the same reference numerals.

Figure 5:
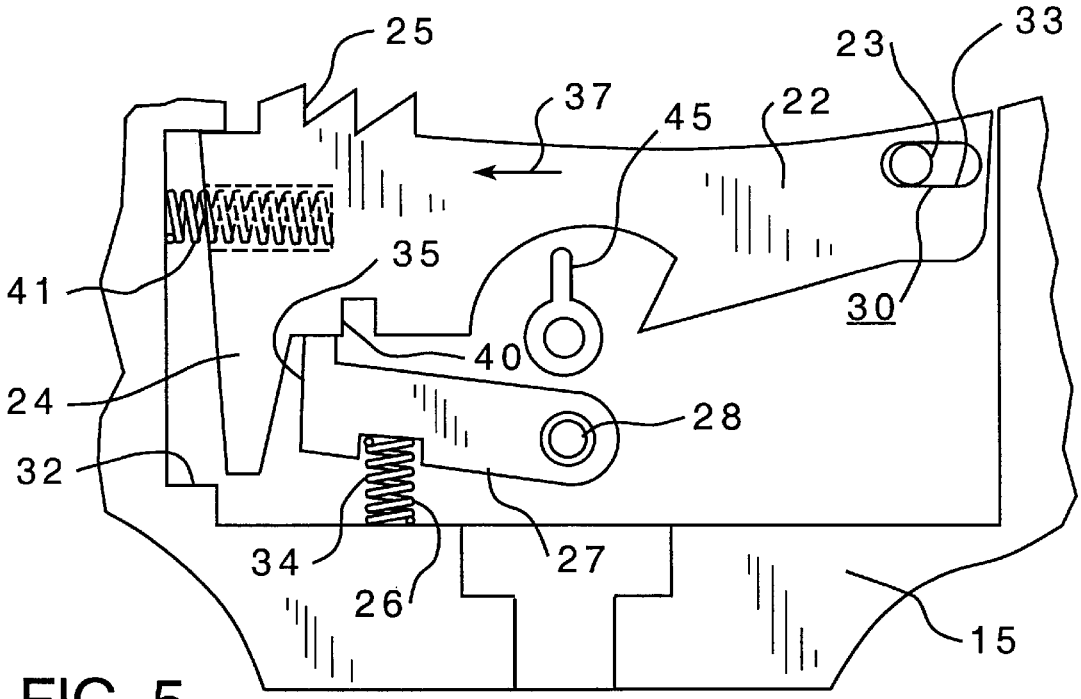
FIGS. 5–8 are schematic representations respectively of four additional embodiments of the double-locking mechanism illustrated in FIGS. 3 and 4.
Figure 6:
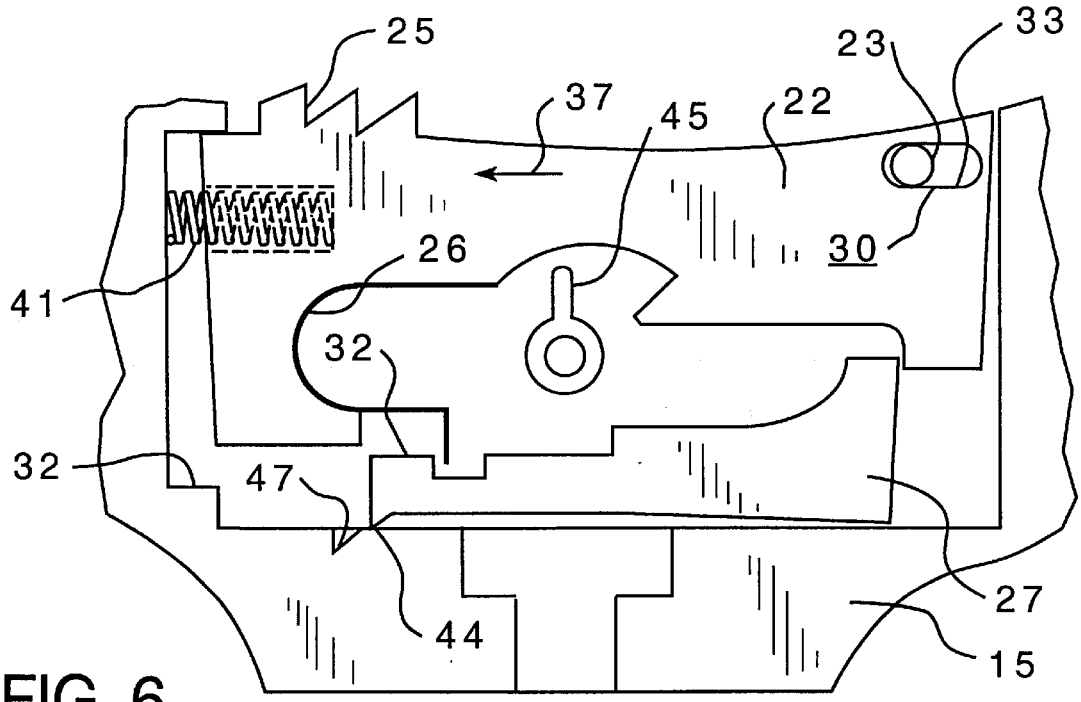

The double-locking mechanism of FIG. 5 operates substantially the same way as the mechanism illustrated in FIGS. 3 and 4, except in this embodiment a single protrusion 35 from bolt 27 is provided and it is received within a step providing shoulder 40 to double lock pawl 22 when pawl 22 is displaced to the left as indicated by arrow 37, in the same manner as previously described, when moved by arm 17. The only other differences are that with this embodiment key 46 must be rotated counter clockwise to first disengage bolt 27 from its second position to its first position so that pawl 22 disengages from the double locked position under the urging of spring 41. Then, key 46 must be rotated in the opposite direction (clockwise) to engage pawl 22 and disengage the teeth 25 thereof from arm 17. Arm 17 is not illustrated in FIGS. 5 through 8 for the purpose of simplicity.

With the embodiment of FIG. 6, again the key 46 must be rotated in opposite directions to fully unlock the cuff. In this embodiment, bolt 27 is slidably moved within housing 15, not pivotally moved as with the other embodiments. Stop 32 is provided on the bolt 27. When pawl 22 is displaced to the left as indicated by arrow 37', bolt 27 is engaged by steel spring 26 and also slides to the left whereby protrusion 44 slips into detent 47 to retain bolt 27 in the second bolt position with stop 32 positioned under pawl 22 to retain it as double locked.

Figure 7:
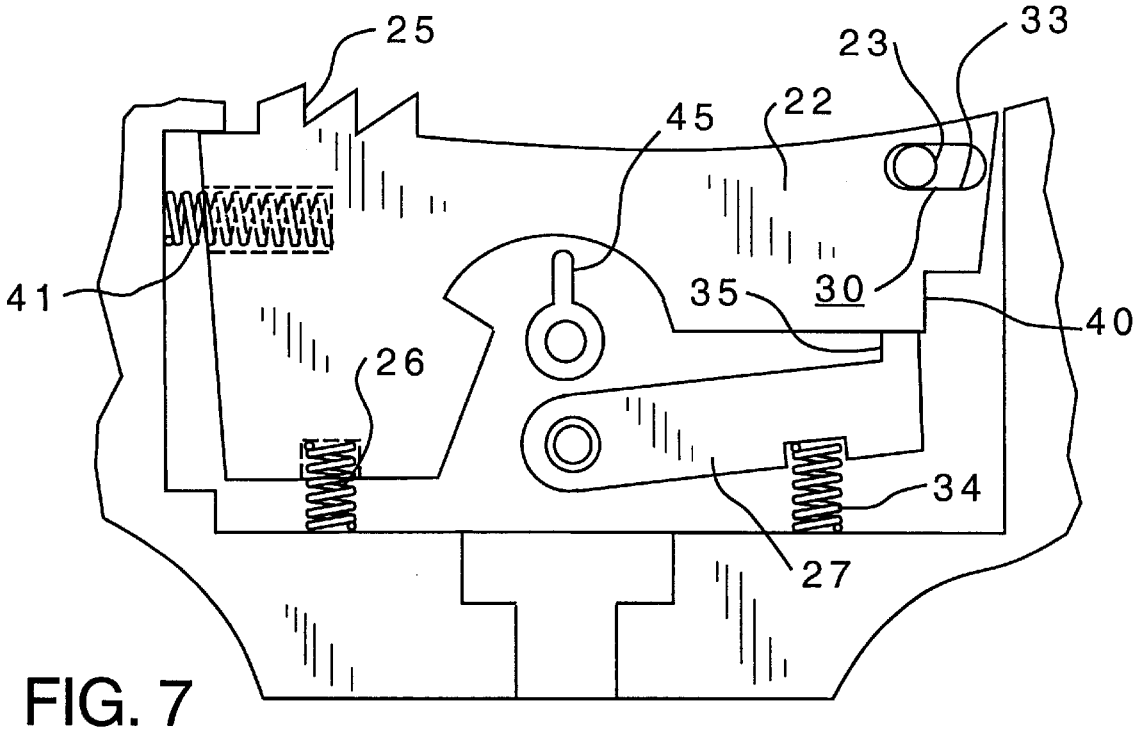

The structure of FIG. 7 is very similar to the embodiment of FIG. 5 except the position of bolt 27 is reversed. In all others respects, it operates in an identical manner.

Figure 8:
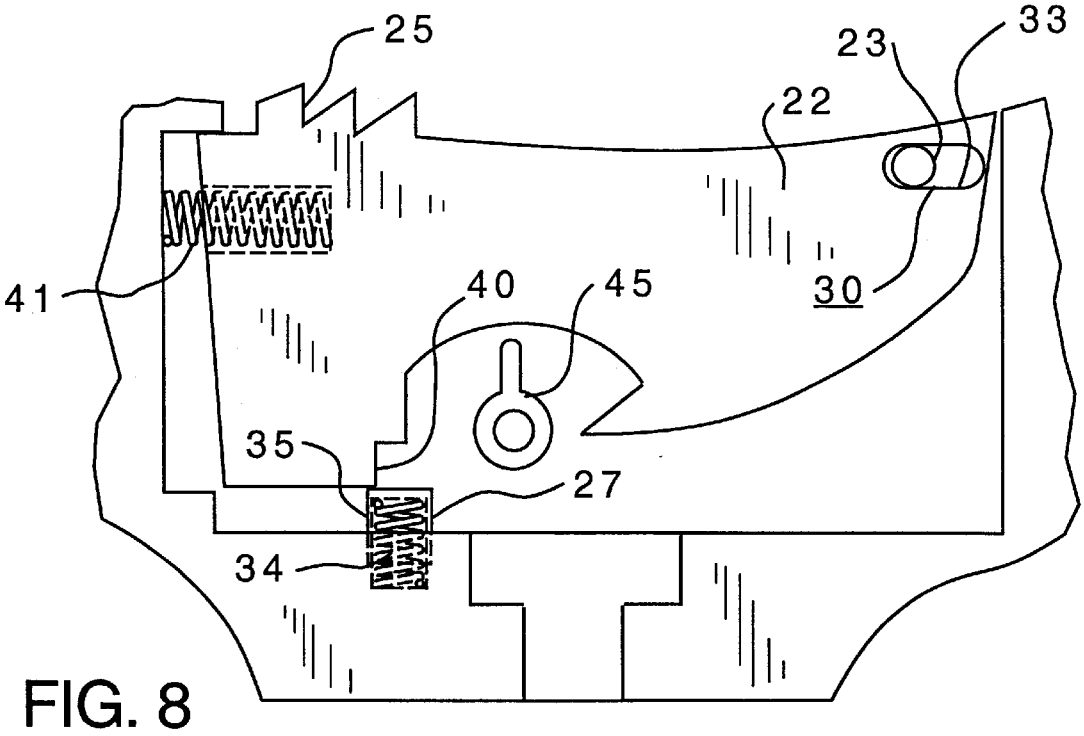

Regarding the structure illustrated in FIG. 8, the bolt 27 is here provided in the form of a piston that is urged upwardly under the pressure of spring 34. However, the mechanism illustrated operates in an identical manner to the structure illustrated in FIG. 5.

Figure 9:
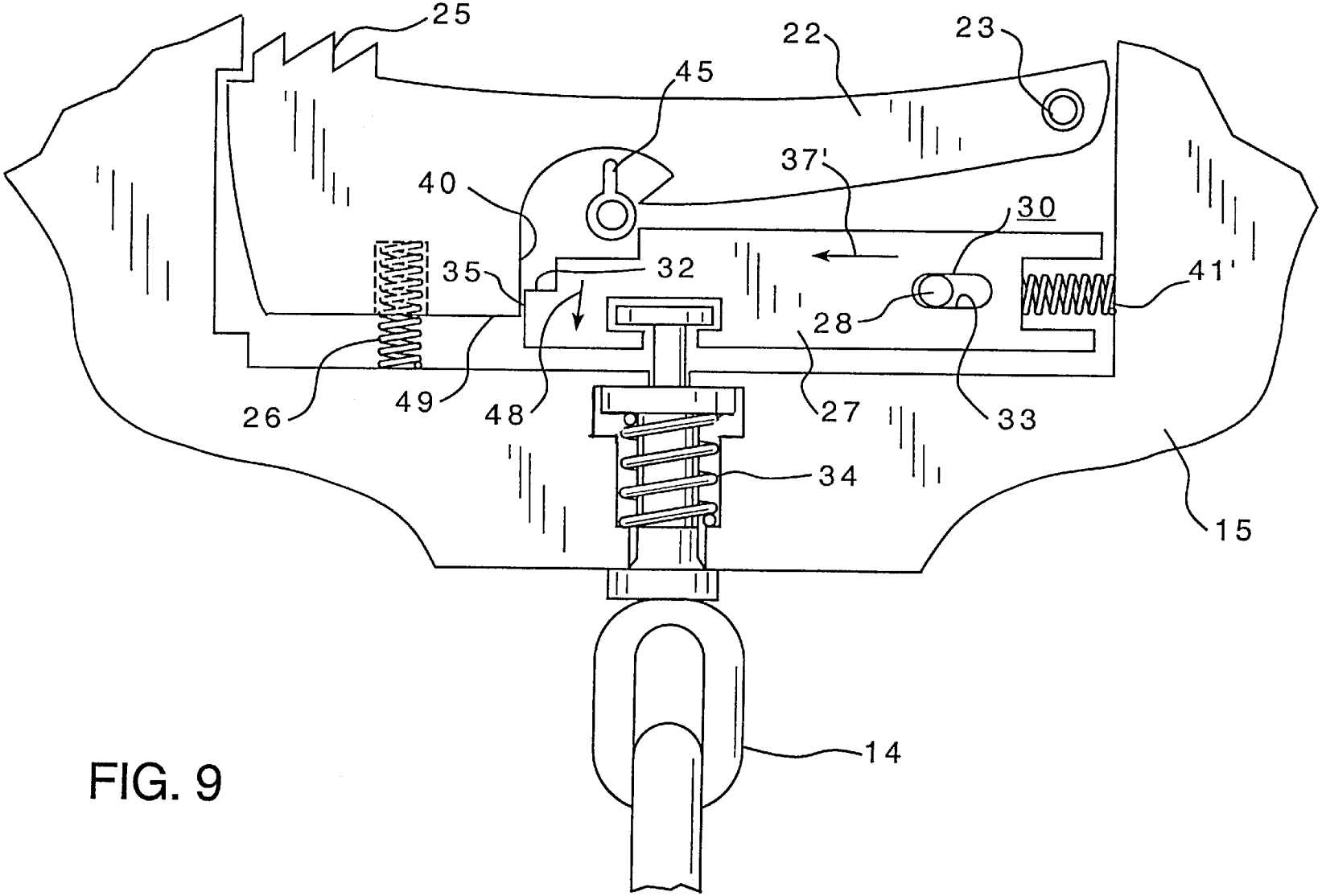
FIG. 9 is a schematic representation of another embodiment of the double-locking mechanism of the present invention.

Referring next to FIG. 9, another embodiment of the present invention is illustrated which utilizes the same principals of the double-locking mechanism illustrated in the previous drawings, but employs a different linkage for actuating the double-locking feature of the mechanism. Identical or similar parts are indicated with the same reference numerals.

The primary differences in this mechanism are that the stop 32 is provided on the bolt 27 instead of on the casing, the pivot slide mechanism 30 is provided on the bolt 27 instead of on the pawl 22, and the mechanism is double locked by pulling downwardly on chain 14 away from casing 15 instead of pulling or pushing the arm 17 away from casing 15 as is accomplished with all of the other embodiments illustrated.

In this embodiment, the pivot 23 of pawl 22 does not permit pawl 22 to slide laterally of the pivot axis. Instead, the pivot slide mechanism 30 is provided on bolt 27. Since pawl 22 does not laterally displace, there is no need or requirement for spring 41 as illustrated in the other embodiments. Instead, this spring is substituted with spring 41' which continually urges bolt 27 to the left as illustrated by arrow 37'.

In order to operate the double-locking mechanism of the structure illustrated in FIG. 9, one merely pulls downwardly on chain 14 which will pull and pivotally displace bolt 27 downwardly as indicated by arrow 48 and will then thereby permit spring 41' to urge bolt 27 to the left as indicated by arrow 37' whereby stop 32 will displace to the left and engage underneath pawl 22 at 49 and thereby retain pawl 22 in a double locked position.

By rotating key 46 counterclockwise, bolt 27 will be displaced to the right and the double locked function will be disengaged and the bolt 27 will be returned to its original position as illustrated in FIG. 9. When key 46 is then rotated clockwise to engage pawl 22, pawl 22 will be pivoted about the axis of pivot 23 downwardly against the compression of spring 26 to completely release the pawl 22 from the arm 17.

I claim:

1. In a shackle of the type having a pawl-and-ratchet mechanism including a spring biased pivotal ratchet pawl that couples a pivotal ratchet jaw arm with a shackle casing, and further including a bolt for providing engagement with said pawl to prevent the coupled jaw from pivoting in either direction, the improvement comprising:

(a) a pivot slide mechanism in said casing permitting pivotal movement of a selected one of said pawl and said bolt about a pivot axis toward and away from said jaw arm and also permitting limited displacement of the selected one of said pawl and said bolt transversely to said pivot axis when engaged and pulled by a connecting member from a first lock position to a second lock position whereby said pawl is caused to engage a stop for retaining said pawl in a double locked position; and (b) said bolt spring biased and dimensioned whereby said bolt is biased from a first bolt position to displace to a second bolt position and thereby engage and retain said pawl in the double locked position against said stop when said selected one of said pawl and said bolt is displaced to the second lock position.

2. The shackle of claim 1, wherein said pivot slide mechanism is comprised of a pivot pin fixed in said casing and received in a guide slot in said pawl for said limited displacement of said pawl as said selected one.

3. The shackle of claim 1, wherein said pivot slide mechanism is provided on said pawl and said connecting member is comprised of said jaw arm.

4. The shackle of claim 3, including a pawl spring in said casing and biased against said pawl to return said pawl to said first lock position when said bolt is displaced from said second bolt position to said first bolt position.

5. The shackle of claim 4, wherein said bolt is pivotally connected at one end to said casing.

6. The shackle of claim 5, including a key-way in said casing adjacent said bolt, said bolt dimensioned to receive and engage a key inserted in said key-way whereby when said key is turned in either direction it operates to place said bolt in said first bolt position and when further turned serves to retract said pawl to disengage said pawl from said jaw arm.

7. The shackle of claim 6, wherein said bolt is spring biased toward said pawl and includes a protrusion extending from its free end in the direction of displacement of said pawl to its double locked position, and a corresponding recess in said pawl for receiving said bolt protrusion when said bolt is in said first bolt position, and a corresponding step on said pawl and positioned adjacent said recess and away from said bolt and dimensioned whereby said protrusion engages said step when said bolt is in said second bolt position and said pawl is thereby retained in said double locked position against said stop and against the bias of said pawl spring.

8. The shackle of claim 1, wherein said pivot slide mechanism is provided on said bolt and said connecting member engages said bolt and extends to the exterior of said shackle casing for hand engagement.

9. The shackle of claim 8, wherein said connecting member includes a shackle chain extending from said shackle casing.

10. In a double-locking shackle device having:

(a) a casing;

(b) a fixed arm, one end of which is held by said casing;

(c) a movable arcuate locking arm, one end of which is pivotally mounted to the other end of said fixed arm and which has a first series of inclined teeth at its free end, said locking arm being dimensioned whereby said free end can move circularly through one side of said casing;

(d) an elongated pawl pivotally mounted by one end within said casing, the free end of which pawl has a second series of inclined teeth dimensioned to engage said first series;

(e) an elongated bolt within said casing and adjacent said pawl; and (f) restraining means resiliently urging said pawl and said second series of inclined teeth against said first series and permitting closure of said locking arm but not opening thereof, said bolt being displaceable within limits from a locking position of engagement with said pawl preventing movement thereof and disengagement of said first and second series of inclined teeth, to an unlocked retracted position allowing movement of said pawl and closure of said locking arm; the improvement comprising:

(g) a pivot slide mechanism in said casing permitting said pivotal movement of said pawl about a pivot axis toward and away from said locking arm and permitting limited lateral displacement of said pawl transversely to said pivot axis when engaged and pulled by said locking arm from a first locked position to a second double locked position whereby said pawl engages a stop in said casing for retaining said pawl in the double locked position; and (h) said bolt biased and dimensioned whereby said bolt is biased from a first bolt position to displace to a second bolt position and thereby engage and retain said pawl in the double locked position against said stop when said pawl is displaced to the second double locked position.

11. The device of claim 10, wherein said pivot slide mechanism is comprised of a pivot pin fixed in said casing and received in a guide slot in said pawl for said limited displacement of said pawl.

12. The device of claim 10, including a pawl spring in said casing and biased against said pawl to return said pawl to said first locked position when said bolt is displaced from said second bolt position to said first bolt position.

13. The device of claim 12, wherein said bolt is pivotally connected to said casing.

14. The device of claim 13, including a key-way in said casing adjacent said bolt, said bolt dimensioned to receive and engage a key inserted in said key-way whereby when said key is turned in either direction it operates to place said bolt in said first bolt position and when further turned serves to retract said pawl to disengage said pawl from said locking arm.

15. The device of claim 14, wherein said bolt is spring biased toward said pawl and includes a protrusion extending from its free end in the direction of displacement of said pawl to its double locked position, and a corresponding recess in said pawl for receiving said bolt protrusion when said bolt is in said first bolt position, and a corresponding step on said pawl and positioned adjacent said recess and away from said bolt and dimensioned whereby said protrusion engages said step when said bolt is in said second bolt position said pawl is thereby retained in said double locked position against said stop and against the bias of said pawl spring.

* * * * *